United States Patent [19]

Leleu et al.

[11] 4,061,581

[45] Dec. 6, 1977

[54] TRIMETHYLOLPROPANE ESTERS USEFUL AS BASE LUBRICANTS FOR MOTOR OILS

[75] Inventors: Gérard Leleu, Grenoble; Pierre Bédague, Biviers; Bernard Sillion, Grenoble, all of France

[73] Assignees: Institut Francais du Petrole; Rhone Progil, both of Rueil Malmaison, France

[21] Appl. No.: 532,237

[22] Filed: Dec. 12, 1974

[30] Foreign Application Priority Data

Dec. 12, 1973 France ..... 73.44459

[51] Int. Cl.[2] ..... C10M 1/48

[52] U.S. Cl. ..... 252/32.7 E; 252/56 S; 260/410.6

[58] Field of Search ..... 252/56 S, 32.7 E; 260/410.6

[56] References Cited

U.S. PATENT DOCUMENTS

| | | | |
|---|---|---|---|
| 2,798,083 | 7/1957 | Bell et al. | 252/56 S X |
| 3,126,344 | 3/1964 | Matuszak et al. | 252/56 S X |
| 3,422,014 | 1/1969 | Forbes et al. | 252/56 S X |
| 3,694,382 | 9/1972 | Kleiman et al. | 252/56 S |
| 3,697,427 | 10/1972 | Byford et al. | 252/56 S X |
| 3,756,952 | 9/1973 | Oberender et al. | 252/56 S X |
| 3,778,454 | 12/1973 | Kleiman et al. | 252/56 S X |
| 3,790,478 | 2/1974 | Rudston et al. | 252/56 S X |
| 3,790,481 | 2/1974 | Byford et al. | 252/56 S X |

*Primary Examiner*—Delbert E. Gantz
*Assistant Examiner*—Andrew H. Metz
*Attorney, Agent, or Firm*—Millen & White

[57] ABSTRACT

A trimethylolpropane ester composition useful as lubricant base for motor-car engines is prepared by total esterification of trimethylolpropane by means of a mixture of saturated aliphatic carboxylic acids comprising 6–33% by mole of dicarboxylic acids having 4–19 carbon atoms and 94–67 % by mole of monocarboxylic acids whereof 5–90% consists of sparingly branched acids comprising 15–30 carbon atoms and 95–10% of straight chain acids comprising 2–30 carbon atoms.

25 Claims, No Drawings

TRIMETHYLOLPROPANE ESTERS USEFUL AS BASE LUBRICANTS FOR MOTOR OILS

This invention concerns new synthetic lubricating bases and motor-oils obtained therefrom.

It is well-known that trimethylol-propane esters are widely used as lubricants for aircraft. In the past few years, it has been proposed to use them also for manufacturing oils for motor-car engines, but the trimethylol-propane esters which are commonly manufactured for use in aircraft, have low viscosities, of 3 to 7 cST at 98.9° C, so that they are not satisfactory for use as motor oils whose viscosity must be usually far higher than 7 cSt at 98.9° C.

It has thus been proposed to thicken them with viscosity additives, so as to form lubricants satisfying at least the standard of the SAE 30 category (viscosity at 98.9° C = 10 cSt). This has at least two disadvantages:

the base oil is highly volatile, the necessary amount of viscosity additive is very high.

These two disadvantages might be obviated if a mixture of trimethylol-propane esters were available, whose viscosity at 98.9° C is high, for example higher than 8 cSt.

It is difficult, particularly for cost reasons, to prepare a simple ester (or a mixture of simple esters) of trimethylolpropane having a high viscosity and a low pour point.

Conversely, it is easier to obtain such a result by preparing a mixture of complex trimethylol-propane esters by esterification of this triol by means of a mixture of mono- and dicarboxylic acids, although the compositions of this type, as described in the priorr art, have a major disadvantage: due to their high content of ester groups, they do not easily dissolve additives, such as those commonly employed in motor oils of a mineral base.

We have now discovered surprisingly that it is possible to manufacture trimethylolpropane ester compositions having both a high viscosity and a considerably increased dissolving power with respect to the conventional additives, as well as a low pour point; such ester compositions are thus well adapted to the formulation of multigrade oils also containing a low proportion of viscosity index improvers.

As a rule, the ester compositions of the invention consist essentially of products obtained by total esterification of trimethylolpropane with mixtures of saturated aliphatic carboxylic acids consisting, in a proportion of 6 to 33% of the carboxy equivalents, of one or more straight or branched dicarboxylic acid comprising from 4 to 19 carbon atoms, and, in a proportion of 94 tp 67% of the carboxy equivalents, of a mixture of monocarboxylic acids comprising from 2 to 30 carbon atoms, these ester compositions being characterized in that said mixture of monocarboxylic acids comprises (a) from 5 to 90% by mole of at least one weakly branched acid comprising 15–30 carbon atoms, and (b) 95 to 10% by mole of at least one straight chain acid comprising from 2 to 30 carbon atoms.

According to the invention, the weakly branched monocarboxylic acids are saturated aliphatic monocarboxylic acids whose chain has one or at most two branches having 1 or 2 carbon atoms. They preferably comprise from 15 to 22 carbon atoms. The acids obtained by isomerization of olefinic fatty acids, followed with a hydrogenation, are of particular interest; they contain as an average one methyl branch per molecule. The liquid acids obtained by hydrogenation of the by-products from the polymerization of olefinic fatty acids, for example according to the method described in U.S. Pat. No. 2,812,342, are particularly convenient, for example isostearic acid, as obtained from a starting olefinic fatty acid containing 18 carbon atoms.

Among the dicarboxylic acids, as hereinbefore defined, we prefer to use, according to the invention, those which comprise from 6 to 12 carbon atoms, for example: adipic acid, methyl adipic acids, azelaic acid, trimethyladipic acids, sebacic acid and dodecanedioic acid.

Among the straight chain monocarboxylic acids, as hereinbefore defined, we prefer to use, according to the invention, those which comprise from 7 to 22 carbon atoms, for example heptanoic acid, pelargonic acid, lauric acid or fatty acid fractions having a high content of lauric acid.

On the other hand, we have found that the most advantageous ester compositions according to the invention are those which are obtained by esterifying trimethylol propane completely by means of mixtures of carboxylic acids in the following proportions:

dicarboxylic acids: from 13 to 33% of carboxy equivalents, monocarboxylic acids: from 87 to 67% of carboxy equivalents among which the molar proportion of weakly branched monocarboxylic acids comprising 15 to 22 carbon atoms is usefully 10 to 70% and the molar proportion of straight chain monocarboxylic acids comprising 7-22 carbon atoms is from 90 to 30%.

A particularly advantageous composition of all the monocarboxylic acids may comprise for example, per each 100 moles, from 10 to 30 moles of weakly branched acid having 15-22 carbon atoms, from 40 to 60 moles of straight chain acids comprising 7–9 carbon atoms and from 20 to 40 moles of straight chain acids comprising from 10 to 16 carbon atoms.

The trimethylol propane ester compositions according to the invention, may be prepared according to any conventional esterification method, making use of the carboxylic acids, as such, their halides, for example their chlorides or bromides, their anhydrides or their lower alkyl esters, optionally in the presence of a conventional esterification or transesterification catalyst, euch as paratoluenesulfonic acid, with the removal of any water and/or alcohol as formed.

The ester compositions according to the invention constitute lubricating bases of high viscosity,. Their viscosity at 98.9° C is usually higher than 8 cSt. They very easily dissolve the conventional additives, such as those conventionally employed in motor oils of mineral base, specifically antioxidant additives and ash-containing and ashless detergent-dispersant additives. They are thus quite adapted to the formulation of multigrade oils of, for example, the 20 W 40 and 20 W 50 SAE types, while additives improving the viscosity index are also added, but in small amounts.

The following examples illustrate the invention.

Isostearic acid, of commercial grade, as used in examples 1, 3, 4 and 6 to 9 has the following characteristics:

Average molecular weight: 310

Acid index: 0.18 g of KDH per gram of material.

Average branching number: about 1 side methyl group per molecule.

In the examples of multigrade oil compositions the following additives have been used:

Antioxidant additives:
- phenyl-beta-naphthylamine
- "OLOA 267" zinc di-thiophosphate Ash containing detergent dispersant additives:
- "OLOA 246 B" calcium sulfonate of TBN = 18 mg/g
- "Lubrizol" phenate of TBN = 210 mg/g
- "OLOA 216" phenate of TBN = 112 mg/g
- "OLOA 218 A" phenate sulfide of TBN = 148 mg/g Ashless detergent-dispersant additives:
- Lubrizol 890 of TBN = 23.5 mg/g (alkenylsuccinimide)
- "OLOA 1200" of TBN = 45 mg/g (alkenylsuccinimide)
- "OLOA 4373" of TBN = 25 mg/g (alkenylsuccinimide)
- "TEXACO TLA 202"

Viscosity index improvers (polymethyacrylates):
- "Garbacryl T 70" and "D 42" (Rhone-Progil)

TBN, as used above, means total base number, as expressed in mg of potassium hydroxide per gram of product.

Examples 2, 5, 9, 12 and 15 are given for comparison.

EXAMPLE 1

A mixture of 134 g (1 mole) of trimethylolpropane, 36.5 g (0.25 mole) of adipic acid, 130 g (1 mole) of heptanoic acid and 465 g (1.5 mole) of isostearic acid is esterified according to a conventional process. Isostearic acid amounts to 60% by mole of all the monocarboxylic acids. The resulting ester has the following properties:

viscosity at −17.8° C: 57 poises
viscosity at 98.9° C: 13.16 cSt
viscosity index $VI_E$: 135
pour point: −32° C

EXAMPLE 2

By way of comparison, an ester whose properties were nearly those given in example 1, except that it did not contain isostearic acid, has been prepared by esterifying a mixture of 134 g (1 mole) of trimethylolpropane, 73 g (0.5 mole) of adipic acid and 260 g (2 moles) of heptanoic acid. The resulting ester had the following properties:

viscosity at −17.8° C: 48 poises
viscosity at 98.9° C: 12.6 cSt
viscosity index $VI_E$: 138
pour point: −40° C

EXAMPLE 3

We have esterified in the same manner a mixture of 134 g (1 mole) of trimethylolpropane, 51.1 g (0.35 mole) of adipic acid, 119.6 g (0.92 mole) of heptanoic acid, 141.4 g (0.69 mole) of a mixture of saturated straight chain aliphatic monocarboxylic acids having from 10 to 16 carbon atoms (fatty acid from coconut oil) and 214 g (0.69 mole) of isostearic acid. The $C_{10}$ - $C_{16}$ acid mixture and isostearic acid each represent 27.6% by mole of all the monocarboxylic acids. The properties of the resulting ester are the following:

viscosity at −17.8° C: 38 poises
viscosity at 98.9° C: 12.34 cSt
viscosity index $VI_E$: 146
pour point: −28° C

EXAMPLE 4

We have esterified in the same manner a mixture of 134 g (1 mole) of trimethylolpropane, 54.75 g (0.375 mole) of adipic acid, 117 g (0.9 mole) of heptanoic acid, 180 g (0.9 mole) of 93% lauric acid and 139.5 g (0.45 mole) of isostearic acid. Lauric acid represents 40% and isostearic acid 20% by mole of all the monocarboxylic acids. The characteristics of the resulting ester are the following:

viscosity at −17.8° C: 37 poises
viscosity at 98.9° C: 12.26 cSt
viscosity index $VI_E$: 148
pour point: −32° C

EXAMPLE 5

By way of comparison, an ester having properties similar to those of the ester of example 4, except that it did not contain isostearic acid, has been prepared by esterification of a mixture of 134 g (1 mole) of trimethylolpropane, 54.75 g (0.375 mole) of adipic acid, 146.25 g (1.125 mole) of heptanoic acid, and 225 g (1.125 mole) of 93% lauric acid The properties of the resulting ester are the following:

viscosity at −17.8° C: 35 poises
viscosity at 98.9° C: 10.7 cSt
viscosity index $VI_E$: 152
pour point: −32° C

EXAMPLE 6

We have esterified in the same way a mixture of 134 g (1 mole) of trimethylolpropane, 65.8 g (0.35 mole) of azelaic acid, 166 g (1.035 mole) of heptanoic acid, 188 g (0.92 mole) of a mixture of straight chain saturated aliphatic monocarboxylic acids having 10–16 carbon atoms (fatty acids of coconut oil) and 107 g (0.345 mole) of isostearic acid. The mixture of $C_{10}$ - $C_{16}$ acids amounts to 40% and isostearic acid to 15% by mole of all the monocarboxylic acids.

The properties of the resulting ester are the following:

viscosity at −17.8° C: 35 poises
viscosity at 98.9° C: 12.45 cSt
viscosity index $VI_E$: 152
pour point: −27° C

EXAMPLE 7

We have esterified as usually 134 g (1 mole) of trimethylolpropane with 69 g (0.3 mole) of dodecane dioic acid, 143 g (1.1 mole) of heptanoic acid, 180 g (0.9 mole) of lauric acid and 124 g (0.4 mole) of isostearic acid. Lauric acid amounts to 37.5% and isostearic acid to 16.7% by mole of all the monocarboxylic acids.

The resulting ester has the following properties:

viscosity at −17.8° C: 27 poises
viscosity at 98.9° C: 11.95 cSt
viscosity index $VI_E$: 159
pour point: −28° C

EXAMPLE 8

We have esterified a mixture of 12.06 kg (90 moles) of trimethylolpropane, 3.94 kg (27 moles) of adipic acid, 13.16 kg (101.25 moles) of heptanoic acid, 13.95 kg (69.75 moles) of lauric acid and 13.93 kg (45 moles) of isostearic acid. Lauric acid amounts to about 32.3% and isostearic acid to about 20.8% by mole of all the monocarboxylic acids. We have obtained 50.6 kg of an ester whose properties are as follows:

viscosity at −17.8° C: 25.5 poises
viscosity at 98.9° C: 9.88 cSt
viscosity index $VI_E$: 148
pour point: −34° C

EXAMPLE 9

By way of comparison, we have esterified a mixture of 134 g (1 mole) of trimethylolpropane, 36.5 g (0.25 mole) of adipic acid, 13 g (0.1 mole) of heptanoic acid and 744 g (2.4 moles) of isostearic acid. Isostearic acid amounts to 96% by mole of all the monocarboxylic acids. The resulting ester has the following properties:
viscosity at −17.8° C: 62 poises
viscosity at 98.9° C: 15.3 cSt
viscosity index $VI_E$: 143
pour point: −20° C The esters, as prepared according to examples 1 to 8, have viscosity properties which make them quite useful for use as base lubricants for multigrade oils. Their pour point is also sufficiently low. Conversely, the ester prepared as described in example 9 with too high a proportion of isostearic acid has too high a pour point.

TEST No. 1: Additive solubilization.

We have attempted to separately dissolve various known detergent-dispersant additives, as identified in Table I by their trade mark reference, into the esters prepared according to examples 1, 8 and also 5. The tests have been conducted at −15° C and at room temperature (+20° C) and conventional concentrations have been employed.

TABLE I

| Ester of example / Composition | | 1 | | 8 | | 5 | |
|---|---|---|---|---|---|---|---|
| Diacid (% COOH equ.) | | 17 | | 20 | | 25 | |
| Monoacids (% COOH equ.) | | 83 | | 80 | | 75 | |
| Isostearic acid/total monoacids (% moles) | | 60 | | 20.8 | | 0 | |
| Additives | | SOLUBILITY* | | | | | |
| Ash-containing detergent-dispersants | | −15° C | +20° C | −15° C | +20° C | −15° C | +20° C |
| OLOA 246 B | 2 % b.w. | yes | yes | yes | yes | no | no |
| OLOA 216 | 3 % b.w. | yes | yes | yes | yes | no | no |
| OLOA 218 A | 3 % b.w. | yes | yes | yes | yes | no | no |
| Ashless-detergent-dispersants | | | | | | | |
| Lubrizol 890 | 4 % b.w. | yes | yes | no | yes | no | no |
| OLOA 1200 | 4 % b.w. | yes | yes | no | yes | no | no |
| OLOA 4373 | 4 % b.w. | yes | yes | yes | yes | no | yes |

*yes = the mixture is perfectly clear at the temperature indicated
no = the mixture is turbid and separates at the temperature indicated.

The results of Table I show that the ester of example 5 cannot be used to dissolve the required amounts of conventional detergent-dispersant additives.

In the following examples 10 to 17, esters prepared according to examples 1 to 6 and 8, have been used as base oils for multigrade oil compositions, further containing:
the amount of viscosity index improvement additive necessary to attain the desired SAE category;
the usual amounts of antioxidant additives and detergent-dispersant additives.

EXAMPLE 10

By using the ester of example 1, we have formulated a lubricating oil by admixing:
Lubrizol 890: 4g
Lubrizol phenate: 2g
Oloa 267: 1g
Phenyl-βnaphthyl amine: 1g
Garbacryl T 70: 3g
Ester of example 1: 89g The mixture remains perfectly clear after storage for a long period at −15° C and has the following properties:
viscosity at −17.8° C : 79 poises
viscosity at 98.9° C : 19.9 cSt
viscosity index $VI_E$: 153
pour point : −31° C
SAE type : 20 W 50

EXAMPLE 11

We have used the same ester to manufacture the following lubricating composition:
Oloa 1200: 4g
Texaco TLA 202: 3g
Oloa 246 B: 2g
Phenyl-62 naphthylamine: 1g
Garbacryl D 42: 4g
Ester of example 1: 86g The mixture is perfectly clear at −15° C and has the following properties:
viscosity at −17.8° C : 86 poises
viscosity at 98.9° C : 20.8 cSt
viscosity index $VI_E$: 153
pour point : −32° C
SAE type : 20 W 50

EXAMPLE 12

By way of comparison, we have attempted to prepare the same mixture with the ester of example 2, free of isostearic acid. The mixtures are very turbid and settle quickly with clear separation of several phases, even at room temperature (+20 ° C). The properties could not be determined.

EXAMPLE 13

The following lubricating composition has been formulated with the ester of example 3.
Lubrizol 890: 5g
Oloa 216: 3g
Oloa 267: 0.5g
Phenyl-β naphthylamine: 1g
Garbacryl D 42: 3g
Ester of example 3: 87.5g The mixture is perfectly clear when stored at −15° C and has the following properties:
viscosity at −17.8° C : 64 poises
viscosity at 98.9° C : 18.45 cSt
viscosity index $VI_E$: 155
pour point : −29+ C
SAE type : 20 W 50

EXAMPLE 14

The following lubricating composition has been prepared with the ester of example 4 :

Oloa 1200: 4g
Oloa 218 A: 3g
Oloa 246 B: 2g
Oloa 267: 1g
Phenyl-$\beta$ naphthylamine: 1 g
Garbacryl D 42: 6g
Ester of example 4: 83g The mixture is perfectly clear after storage at $-15°$ C and has the following properties:

viscosity at $-17.8°$ C : 64 poises
viscosity at 98.9° C : 22.1 cSt
viscosity index $VI_E$: 169
pour point : $-32°$ C
SAE type : 20 W 50

EXAMPLE 15

By way of comparison, we have made the same mixtures with the ester of example 5, free of isostearic acid. The mixtures are turbid and settle at room temperature (+20° C). The properties could not be determined.

EXAMPLE 16

The following composition has been manufactured by using the ester of example 6:

Oloa 1200: 4g
Oloa 218 A: 3g
Oloa 267: 1g
Phenyl-$\beta$ naphthylamine: 1g
Garbacryl T 70: 5g
Ester of example 6: 86g The mixture remains perfectly clear at $-10°$ C and has the following properties:

viscosity at $-17.8°$ C : 50 poises
viscosity at 98.9° C : 22.3 cSt
viscosity index $VI_E$: 180
pour point : $-25°$ C
SAE type : 20 W 50

TEST No. 2

We have subjected the lubricating compositions according to the invention to the so-called Indiana tests, in order to determine their stability with respect to oxidation. These Indiana tests are described in Industrial and Engineering Chemistry, vol. 13 No. 5 (1941) p. 317–321 under the head "Indiana Stirring Oxidation Test for Lubricating Oils".

According to these tests, the lubricant sample, free of viscosity additive, is maintained at a temperature of 160° C under strong stirring, in the presence of air and copper and steel samples, for 72 hours. The variation of the oil viscosity at 37.8° C is determined, and also its acid number, its content of copper and of matter insoluble in heptane. The results given in Table II show the resistance to oxidation-corrosion of the lubricating composition of example 13 (without Garbacryl D 32) and also that of a composition available in the trade, based on a mineral oil (tested for comparison).

TABLE II

| | Oil of example 13 | Mineral base oil |
|---|---|---|
| Viscosity variation at 37.8° C | | |
| . 24 h | + 4.6 | + 19.5 |
| % . 48 h | + 7.8 | + 29.5 |
| . 72 h | + 9.5 | + 81.2 |

TABLE II-continued

| | Oil of example 13 | Mineral base oil |
|---|---|---|
| Final acid number (mg/g) | 2.4 | 5.6 |
| Final content of | | |
| - copper (ppm) | 10 | 160 |
| - insoluble in heptane (%) | 0.1 | 0.2 |

EXAMPLE 17

A lubricating oil has been prepared by means of the ester of example 8 containing:

Oloa 4373: 4g
Oloa 246 B: 2g Oloa 218 A: 2g
Oloa 267: 1.5g
Phenyl-$\beta$ naphthylamine: 1g
Garbacryl D 42: 5g
Ester of example 8: 84.5g This oil has the following properties:

viscosity at $-17.8°$ C : 42.5 poises
viscosity at 98.9° C : 17.39 cSt
viscosity index $VI_E$: 168
pour point : $-27°$ C
SAE type : 20 W 50

TEST No. 3

The oil of example 17 has been subjected to an oxidation-corrosion test on a Peter W1 engine, which shows the corrosiveness of an oil with respect to copper-lead bearings. The standard test takes 36 hours; it has been continued beyond that time, in order to observe a great corrosion of the bearings, corresponding to a loss of weight of more than 100 mg. The losses of weight of the bearings in 36, 72 and 108 hours are given in the following table III, which also gives, by way of comparison, the results obtained with a synthetic ester base oil of the trade.

TABLE III

| Loss of weight of the Cu/Pb bearings in | Oil of example 13 | Oil of the trade |
|---|---|---|
| 36 hours | 8 mg | 40 mg |
| 72 hours | 35 mg | 191 mg |
| 108 hours | 104 mg | |

What we claim is:

1. A trimethylol-propane ester composition useful as lubricant base for motor-car engines, consisting essentially of the product obtained by total esterification of trimethylolpropane by means of a diversity of saturated aliphatic-hydrocarbyl carboxylic acids, said diversity having in a proportion of 6 to 33% of the carboxy equivalents, at least one straight or branched-chain dicarboxylic acid having from 4 to 19 carbon atoms, and in a proportion of 94 to 67% of the carboxy equivalents, a mixture of monocarboxylic acids, wherein said mixture of monocarboxylic acids comprises:

a. from 10 to 70% by mole of at least one branched chain acid having from 15 to 22 carbon atoms and selected from the group consisting of those having one methyl side chain, those having two methyl side chains, those having one ethyl side chain, those having one methyl and one ethyl side chains, and those having two ethyl side chains, and
b. from 90 to 30% by mole of at least one straight chain acid having from 7 to 22 carbon atoms.

2. A composition according to claim 1, wherein the branched chain acid is obtained by isomerization of an olefinic fatty acid of 15–22 carbon atoms, followed with hydrogenation.

3. A composition according to chain 1, wherein the branched chain acid is isostearic acid.

4. A composition according to claim 1, wherein the dicarboxylic acid contains 6–12 carbon atoms.

5. A composition according to claim 1, wherein in said diversity of carboxylic acids, the proportion of dicarboxylic acid is from 13 to 33% of the carboxy equivalents, and the proportion of monocarboxylic acid is from 87 to 67% of the carboxy equivalents.

6. In a synthetic ester based lubricating oil composition, comprising a major proportion of a synthetic ester base oil and in amounts sufficient to effect each additives attendant function of an antioxidant, viscosity index improver and detergent-dispersant, the improvement comprising using as the base oil the ester of claim 1.

7. A lubricating oil according to claim 6, wherein said viscosity index improver is added in an amount sufficient to yield a final composition of 20 W 40 SAE multigrade oil.

8. A lubricating oil according to claim 6, wherein said viscosity index improver is added in an amount sufficient to yield a final composition of 20 W 50 SAE multigrade oil.

9. The oil of claim 8, wherein the viscosity index improver comprises from about 3% to about 6% by weight of said oil.

10. A trimethylol-propane ester composition according to claim 5 wherein the dicarboxylic acid is adipic acid, and wherein the branched chain monocarboxylic acid (a) is isostearic acid, and the straight chain monocarboxylic acid (b) is heptanoic acid.

11. The lubricating oil of claim 6, comprising 89% by weight of said trimethylol-propane ester base oil formed from adipic acid, isostearic acid and heptanoic acid as said carboxylic acids; 4% by weight of an ashless alkenylsuccinimide detergent dispersant additive; 2% by weight of a phenate; 1% by weight of a zinc dithiophosphate; 1% by weight of phenyl-β-naphthylamine; and 3% by weight of a polymethacrylate viscosity index improver.

12. A trimethylol-propane ester composition useful as lubricant base for motor-car engines, consisting essentially of the product obtained by total esterification of trimethylolpropane by means of a diversity of saturated aliphatic-hydrocarbyl carboxylic acids, said diversity having in a proportion of 6 to 33% of the carboxy equivalents, at least one straight or branched-chain dicarboxylic acid having from 4 to 19 carbon atoms, and in a proportion of 94 to 67% of the carboxy equivalents, a mixture of monocarboxylic acids, said mixture comprising:

a. from 10 to 30% by mole of a branched chain acid containing 15-22 carbon atoms and selected from the group consisting of those having one methyl side chain, those having two methyl side chains, those having one ethyl side chain, those having one methyl and one ethyl side chains, and those having two ethyl side chains, and b. from 40 to 60% by mole of straight-chain acid containing 7 to 9 carbon atoms and from 20 to 40% by mole of straight chain acid containing 10 to 16 carbon atoms.

13. A composition according to claim 12, wherein the branched chain acid is obtained by isomerization of an olefinic fatty acid of 15–22 carbon atoms, followed with hydrogenation.

14. A composition according to claim 12, wherein the branched chain acid is isostearic acid.

15. A composition according to claim 12, wherein the dicarboxylic acid contains 6–12 carbon atoms.

16. A composition according to claim 12, wherein in the diversity of carboxylic acids, the proportion of dicarboxylic acid is from 13 to 33% of the carboxy equivalents, and the proportion of monocarboxylic acid is from 87 to 67% of the carboxy equivalents.

17. In a lubricating oil for motor-car engines, which comprises a major proportion of a synthetic ester base oil and in amounts sufficient to effect each additive's attendant function of viscosity index improver, antioxidant and detergent-dispersant the improvement comprising using as the base oil, the ester of claim 12.

18. A lubricating oil according to claim 17, wherein said viscosity index improver is added in an amount sufficient to yield a final composition of 20 W 40 SAE multigrade oil.

19. A lubricating oil according to claim 17, wherein said viscosity index improver is added in an amount sufficient to yield a final composition of 20 W 50 SAE multigrade oil.

20. The oil of claim 19 wherein the viscosity index improver comprises from about 3% to about 6% by weight of said oil.

21. A trimethoylol-propane ester composition according to claim 16 wherein the dicarboxylic acid is adipic acid, azelaic acid, or dodecanedioic acid, the straight chain monocarboxylic acid of 7–9 carbon atoms is heptanoic acid, the straight chain monocarboxylic acid of 10–16 carbon atoms is lauric acid or a cut of fatty acids from coconut oil, and the branched chain monocarboxylic acid of 15–22 carbon atoms is isostearic acid.

22. The lubricating oil of claim 17, comprising 87.5% by weight of said trimethylol-propane ester base oil formed from adipic acid, heptanoic acid, a mixture of saturated straight-chain aliphatic monocarboxylic acid having from 10 –16 carbon atoms, and isostearic acid; 5% by weight of an ashless alkenylsuccinimide detergent dispersant additive: 3% by weight of a phenate; 0.5% by weight of zinc dithiophosphate; 1% by weight of phenyl-β-naphthylamine; and 3% by weight of a polymethacrylate viscosity index improver.

23. The lubricating oil of claim 17, comprising 83% by weight of said trimethylol-propane ester base oil formed from adipic acid, heptanoic acid, lauric acid, and isostearic acid; 4% by weight of an ashless alkenylsuccinimide detergent-dispersant additive; 3% by weight of a phenate sulfide; 2% by weight of calcium sulfonate; 1% by weight zinc di-thiophosphate; 1% by weight of phenyl-β-napthylamine; and 6% by weight of a polymethacrylate viscosity index improver.

24. The lubricating oil of claim 17, comprising 86% by weight of said trimethylol-propane ester base oil formed from azelaic acid, heptanoic acid, a mixture of straight-chain saturated aliphatic monocarboxylic acids having 10–16 carbon atoms, and isostearic acid; 4% by weight of an ashless alkenylsuccinimide detergent dispersant additive; 2% by weight of a phenate sulfide; 1% by weight of zinc dithiophosphate; 1% by weight of phenyl-β-naphtylamine; and 5% by weight of a polymethacrylate viscosity index improver.

25. The lubricating oil of claim 17, comprising 84.5% by weight of said trimethylol-propane ester base oil formed from adipic acid, heptanoic acid, lauric acid, and isostearic acid; 4% by weight of an ashless alkenylsuccinimide detergent dispersant additive; 2% by weight of calcium sulfonate; 2% by weight of phenate sulfide; 1.5% by weight of zinc di-thiophosphate; 1% by weight phenyl-β-naphtylamine; and 5% by weight of a polymethacrylate viscosity index improver.

* * * * *